United States Patent [19]

Lauke et al.

[11] Patent Number: 5,073,475

[45] **Date of Patent: * Dec. 17, 1991**

[54] PRODUCTION OF PLATE-LIKE, SHEET-LIKE OR TAPE-LIKE MATERIALS AND OF SENSITIZED LITHOGRAPHIC PRINTING PLATES

[75] Inventors: Harald Lauke, Mannheim; Gregor Schuermann, Heidelberg; Hartmut Sandig, Frankenthal; Thomas Loerzer, Appenweier, all of Fed. Rep. of Germany

[73] Assignee: BASF Aktiengesellschaft, Ludwigshafen, Fed. Rep. of Germany

[ * ] Notice: The portion of the term of this patent subsequent to Jun. 19, 2007 has been disclaimed.

[21] Appl. No.: 571,231

[22] Filed: Aug. 23, 1990

[30] Foreign Application Priority Data

Aug. 31, 1989 [DE] Fed. Rep. of Germany ..... 3928794

[51] Int. Cl.[5] ..... G03C 1/77; G03C 1/74

[52] U.S. Cl. ..... 430/278; 430/276

[58] Field of Search ..... 430/161, 278, 302, 278, 430/272; 204/35.1

[56] References Cited

U.S. PATENT DOCUMENTS

| | | | |
|---|---|---|---|
| 3,440,050 | 4/1969 | Simon Chu | 430/278 |
| 4,782,000 | 11/1988 | Lauke et al. | 430/60 |
| 4,935,332 | 6/1990 | Laurr et al. | 430/302 |
| 4,939,068 | 7/1990 | Lauke et al. | 430/278 |

*Primary Examiner*—John Niebling
*Assistant Examiner*—Kishor Mayekar
*Attorney, Agent, or Firm*—Keil & Weinkauf

[57] ABSTRACT

A sensitized lithographic printing plate comprising an aluminum substrate which has been mechanically, chemically and/or electrochemically pretreated and anodically oxidized in a conventional manner and a photosensitive copying layer which is applied to this substrate is produced by a process in which the substrate is aftertreated with an aqueous solution of a mixture of a fluoride and a hydrolysis product or condensate of a silane before application of the photosensitive copying layer.

There lithographic printing plates are particularly suitable for offset printing.

10 Claims, No Drawings

PRODUCTION OF PLATE-LIKE, SHEET-LIKE OR TAPE-LIKE MATERIALS AND OF SENSITIZED LITHOGRAPHIC PRINTING PLATES

The present invention relates to a process for the production of plate-like, sheet-like or tape-like materials based on roughened and anodically oxidized aluminum or one of its alloys, aluminum oxide layers thereof being aftertreated with an aqueous solution of a silane hydrolysis product and/or condensate which contains a further additive. The present invention furthermore relates to a process for the production of sensitized lithographic printing plates by aftertreatment of mechanically, chemically and/or electrochemically roughened and anodically oxidized aluminum substrates and their use as offset printing plates.

Offset printing plates generally consist of a substrate on which a radiation-sensitive reproduction layer has been applied, with the aid of which an image is produced by a photomechanical method from a transparency. After the production of the printing plate, the substrate carries the image areas, which are ink-accepting during subsequent printing, and at the same time forms the water-accepting background (nonimage areas) in the image-free areas.

A substrate which is to be suitable for photo-sensitive material for the production of a printing plate must therefore meet the following requirements: on the one hand, the printing image areas developed from the copying layer of the material must adhere very firmly to the said substrate and on the other hand the substrate must form a hydrophilic background and must retain its repellent effect against oleophilic printing inks under the requirements of the printing process. Hence, the substrate must to a certain extent always have a porous surface structure so that its surface can retain sufficient water to repel to an adequate extent the printing ink used in printing.

Suitable substrates of photosensitive layers are aluminum, steel, copper, brass and zinc sheets.

As a rule, aluminum and aluminum alloys, which are modified by a number of pretreatment steps to ensure good adhesion of the radiation-sensitive layer and hence long print runs, are used for offset printing plates.

For example, aluminum is mechanically, chemically and/or electrochemically roughened, if necessary pickled and then anodically oxidized. Electrochemical roughening in HCl and/or $HNO_3$ and anodic oxidation in $H_2SO_4$ and/or $H_3PO_4$ are standard methods familiar to the skilled worker.

In the prior art, it is usual to subject such anodized substrates to a further treatment step to improve the layer adhesion, to increase the hydrophilicity and/or to facilitate development of the photo-sensitive copying layers. The patent literature described, inter alia, methods such as treatment with silicate (cf. for example DE-A-25 32 769 or U.S. Pat. No. 3,902,976) or the treatment with polyvinylphosphonic acid (cf. for example DE-B-1 134 093, U.S. Pat. No. 3,276,868, DE-B-1 621 478 and U.S. Pat. No. 4,153,461).

The use of a complex flourides (cf. for example DE-A-1 300 415, DE-A-1 796 159, GB-A-1 128 506 and U.S. Pat. No. 3,440,050), for example of Zr, Hf or Ti, and successive aftertreatment with $K_2ZrF_6$ and sodium silicate (cf. for example DE-A-28 10 309) are also known.

However, the methods described above have certain disadvantages. For example, in the treatment with alkali metal silicates, a certain deterioration in the shelf life must be accepted.

The use of polyvinylphosphonic acid for aftertreatment of substrates results in good printing properties of the printing plates, but the deposition of polyvinylphosphonic acid on the substrate may lead to difficulties in production, such as the formation of an extremely sparingly soluble precipitate by reaction with $Al^{3+}$ ions, which results during printing in wetting problems or fragmentation of the layer.

Hydrolysis products of special silanes carrying hydrophilic terminal groups, as described in DE-A-36 27 757, DE-A-36 27 758, EP-A-0 256 256, EP-A-0 256 255 and U.S. Pat. No. 4,782,000, can be used in order to avoid the abovementioned disadvantages.

If these silanes are used for the aftertreatment of offset substrates, the printing plates produced therefrom have an excellent shelf life.

However, the skilled worker is aware that in some cases the hydrophilicity is increased to such an extent that the processing latitude of the printing plates during development with aqueous/alkaline developers may be very narrow since, for example, the resistance of the image-carrying parts to the developer is reduced, so that in particular very fine image structures may become detached during development.

It is an object of the present invention to provide an aftertreatment which imparts an excellent shelf life to the printing plate and at the same time increases the processing latitude so that the copying characteristics of the printing plate do not change even after prolonged development, particularly with strongly alkaline developers.

We have found that this object is achieved and that, surprisingly, the novel aftertreatment of aluminum substrates, pretreated according to the prior art with an aqueous solution of a silane hydrolysis product, which solution is formed by hydrolysis of silanes and additionally contains a free or complexed flouride, greatly improves the hydrophilic properties of the substrate and at the same time results in very high resistance of even very fine photocured parts of the photosensitive layer to the developer (alkali), so that the imagewise exposed printing plate possesses a very broad processing latitude during development.

The present invention relates to a process for the production of plate-like, sheet-like or tape-like materials based on mechanically, chemically and/or electrochemically roughened and anodically oxidized aluminum or aluminum alloy, the aluminum oxide layers thereof being treated with an aqueous solution of a hydrolysis product and/or condensate of one or more silanes of the general formula (I)

$$X-(CH_2)_y-Si(R^1)_n(OR^2)_{3-n} \qquad (I)$$

where $R^1$ and $R^2$ are identical or different and are each alkyl of 1 to 9 carbon atoms or aryl of 6 to 12 carbon atoms and X is one of the radicals

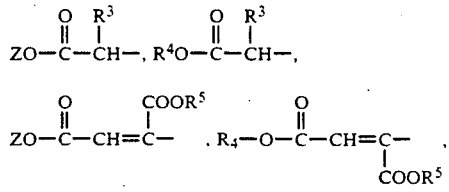

-continued

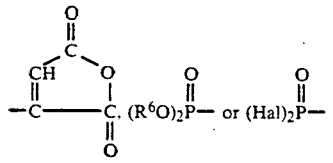

where $R^3$ is hydrogen, alkyl of 1 to 9 carbon atoms, a carboxylic acid radical of 1 to 9 carbon atoms or an anhydride ring formed from this carboxylic acid radical and the radical

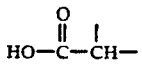

bonded to $R^3$, $R^4$ and $R^5$ are identical or different and are each alkyl of 1 to 9 carbon atoms or aryl of 6 to 12 carbon atoms, $R^6$ is hydrogen, alkyl of 1 to 9 carbon atoms or aryl of 6 to 12 carbon atoms, Z is hydrogen or alkali metal, Hal is chlorine or bromine, y is an integer of from 1 to 4 and n is 0, 1 or 2, wherein the aqueous solution of the silane hydrolysis product and/or condensate additionally contains one or more compounds of the general formula (II) or (III)

$$\underset{(II)}{MF} \quad \text{or} \quad \underset{(III)}{M_2XF_6}$$

where M is an alkali metal and X is Ti, Zr or Si.

The aqueous solution used according to the invention for the treatment of the aluminum oxide layers preferably has a pH of from 1.5 to 6.0.

The treatment with the aqueous solution is preferably carried out in the course of from 5 to 120 seconds at from 10° to 90° C., the aqueous solution used for the treatment containing from 0.5 to 100 g/l of a hydrolysis product and/or condensate of one or more silanes of the general formula (I) and from 0.1 to 50 g/l of one or more compounds of the general formula (II) or (III).

In the general formulae (II) or (III), M is preferably Na or K.

$K_2ZrF_6$ is particularly preferably added to the aqueous solution of the silane hydrolysis product and/or condensate.

The present invention also relates to a process for the production of sensitized lithographic printing plates or offset printing plates from a substrate and a photosensitive copying layer which is applied to this substrate, wherein the substrate to be used for this purpose is treated by the novel process before being coated with the photosensitive copying layer.

Regarding the novel process, the following may be stated specifically.

The aluminum substrate (aluminum or alloys of aluminum) to be used for the novel process is mechanically, chemically and/or electrochemically pretreated and anodically oxidized, these steps being carried out in a conventional manner.

Pretreatment methods of this type are described in, for example, Wernick, Pinner, Zurbrügg and Weiner, Die Oberflächenbehandlung von Aluminium, Eugen G. Leuze Verlag, 1977.

In the novel process, the aluminum (alloy) substrate pretreated as stated above is aftertreated by a conventional application method, such as spraying or immersion, excess is removed, if necessary, by washing with water and drying is carried out, in general at from 50° to 120° C., before coating with the photosensitive copying layer.

The hydrolysis product or condensate of the silane is advantageously used in aqueous or alcoholic solution and can be prepared in a conventional manner by uncatalyzed or acid-catalyzed hydrolysis of the parent silanes of the general formula (I).

As stated above, silanes used for the novel process are those of the general formula (I)

$$X-(CH_2)_y-Si(R^1)_n(OR^2)_{3-n} \qquad (I)$$

where $R^1$ and $R^2$ are identical or different and are each alkyl of 1 to 9, preferably 1 to 4, carbon atoms, e.g. methyl, ethyl, propyl, isopropyl, butyl or isobutyl, or aryl of 6 to 12 carbon atoms, such as phenyl, benzyl or methylphenyl, and X is one of the radicals

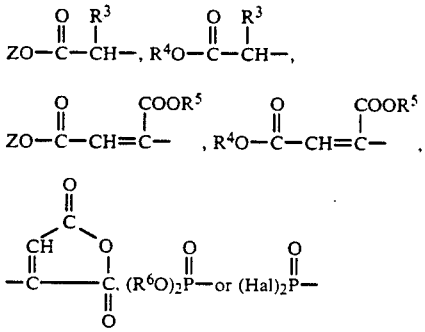

where $R^3$ is hydrogen, alkyl of 1 to 9, preferably 1 to 5, carbon atoms, e.g. methyl, ethyl, propyl or butyl, a carboxylic acid radical of 1 to 9, preferably 1 to 4, carbon atoms, e.g. —COOH, $-CH_2COOH$, $-C_2H_4COOH$ or $-C_3H_6-COOH$, or an anhydride ring formed from this carboxylic acid radical and the radical

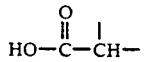

bonded to $R^3$, for example a succinic anhydride ring, $R^4$ and $R^5$ are identical or different and are each alkyl of 1 to 9, preferably 1 to 4, carbon atoms, e.g. methyl, ethyl, propyl or butyl, or aryl of 6 to 12 carbon atoms, e.g. phenyl, benzyl or methylphenyl, $R^6$ is hydrogen, alkyl of 1 to 9, preferably 1 to 4, carbon atoms, e.g. methyl, ethyl, propyl or butyl, or aryl of 6 to 12 carbon atoms, e.g. phenyl, benzyl or methylphenyl, Z is hydrogen or an alkali metal, such as Li, Na or K, or $NH_4$, Hal is chlorine or bromine, preferably chlorine, y is an integer of from 1 to 4, in particular 3, and n is 0, 1 or 2.

Examples of preferred silanes are
3-trimethoxysilylpropylcarboxylic acid,
3-triethoxysilylpropylsuccinic anhydride,
dimethyl 2-trimethoxysilylethylphosphonate,
diethyl 2-triethoxysilylethylphosphonate,
diethyl 3-triethoxysilylpropylphosphonate,
2-trimethoxysilylethylphosphonic acid and
2-trimethoxysilylethylphosphonyl dichloride.

Particularly preferred silanes are
3-triethoxysilylpropylsuccinic anhydride,
dimethyl 2-trimethoxysilylethylphosphonate and diethyl 2-triethoxysilylethylphosphonate.

The hydrolysis of such silanes can be carried out in a conventional manner by dissolving the silane in water, in the presence or absence of an acid, in aqueous solutions of alcohols or in concentrated mineral acids, e.g. HCl. A certain amount of condensates may also be formed during the hydrolysis. Hydrolysis products, condensates and mixtures of hydrolysis products and condensates of the abovementioned silanes are suitable for the novel process, provided that it is ensured that the hydrolysis products or condensates are completely dissolved in the aqueous or alcoholic solution.

Examples of fluorides of the general formulae (II) and (III) are sodium fluoride, potassium fluoride, sodium hexafluorozirconate, potassium hexafluorozirconate, sodium hexafluorotitanate, potassium hexafluorotitanate and $Na_2SiF_6$ (sodium hexafluorosilicate).

Particularly preferred fluorides are sodium fluoride and potassium hexafluorozirconate.

The aqueous aftertreatment solutions to be used for the novel process contain the fluorides of the general formulae (II) and/or (III) in general in amounts of from 0.01 to 5, preferably from 0.05 to 2, % by weight and the silane hydrolysis products in amounts of from 0.05 to 10, preferably from 0.1 to 4% by weight. The pH of these aqueous solutions is preferably from 1.5 to 6, in particular from 2 to 4.

The pH can, if required, be brought to the desired value by adding suitable substances.

The novel aftertreatment of the aluminum substrates with the aqueous solutions is preferably carried out at from 10° to 90° C., in particular from 20° to 70° C.; the duration of the treatment is preferably from 5 to 120, in particular from 10 to 60, seconds.

After the novel treatment of the pretreated aluminum substrate with the solution of the mixture of hydrolysis product or condensate of the silane and the fluorine compounds of the formulae (II) and/or (III) and drying of the thin layer, the aftertreated aluminum substrate can be provided with the photosensitive copying layer in a conventional manner. The said layer is a radiation-sensitive coating. Photopolymerizable mixtures which contain known photopolymerizable olefinically unsaturated compounds, such as monomers and/or oligomers, which are partially or completely polyolefinically unsaturated and can be converted rapidly in the presence of photoinitiator systems by exposure to actinic light into products which are sparingly soluble or insoluble in developers, are suitable for this purpose. The photopolymerizable olefinically unsaturated compounds which are known per se for UV-crosslinkable binders and for photopolymer printing plates are suitable, the type and amount depending on the intended use of the mixtures and on any polymeric binder present, with which they should be compatible. In a preferred embodiment, this layer contains a photocrosslinkable polymer as binder and a polyfunctional, ethylenically unsaturated monomer and a photoinitiator system consisting of one or more components, and furthermore conventional additives, such as suitable colorants, thermal-polymerization inhibitors and plasticizers. The layer is then dried.

Examples of suitable polymers are methyl methacrylate/methacrylic acid copolymers, styrene/methacrylic acid copolymers and methacrylic acid/acrylic acid copolymers and, if required, also polyurethanes, unsaturated polyesters and/or polyesterurethanes.

Suitable olefinically unsaturated compounds are, for example, di- and polyacrylates and -methacrylates, as can be prepared by esterification of diols or polyols with acrylic acid or methacrylic acid, such as the di- and tri(meth)acrylates of ethylene glycol, diethylene glycol, triethylene glycol, polyethylene glycol having a molecular weight of not more than about 500, 1,2-propanediol, 1,3-propanediol, neopentylglycol (2,2-dimethylpropanediol), 1,4-butanediol, 1,1,1-trimethylolpropane, glycerol or pentaerythritol, and the monoacrylates and monomethacrylates of such diols and polyols, for example ethylene glycol monoacrylate or di-, tri- or tetraethylene glycol monoacrylates, and monomers which have two or more olefinically unsaturated bonds and contain urethane groups and/or amide groups, such as the low molecular weight compounds prepared from aliphatic diols of the abovementioned type, organic diisocyanates and hydroxyalkyl (meth)acrylates. Other examples are acrylic acid, methacrylic acid and derivatives thereof, such as (meth)acrylamide, N-hydroxymethyl(meth)acrylamide or (meth)acrylates of monoalcohols of 1 to 6 carbon atoms.

Suitable photoinitiators are the photoinitiators or photoinitiator systems known per se and conventionally used for photosensitive, photopolymerizable recording materials. Examples of these are benzoin, benzoin ethers, in particular benzoin alkyl ethers, substituted benzoins, alkyl ethers of substituted benzoins, for example α-methylbenzoin alkyl ethers or α-hydroxymethylbenzoin alkyl ethers; benzil, benzil ketals, in particular benzil dimethyl ketal, benzil methyl ethyl ketal or benzil methyl benzyl ketal; the acylphosphine oxide compounds which are known to be effective photoinitiators, for example 2,4,6-trimethylbenzoyldiarylphosphine oxide; benzophenone, derivatives of benzophenone, 4,4'-dimethylaminobenzophenone, 4,4'-diethylaminobenzophenone, derivatives of Michler's ketone; anthraquinone and substituted anthraquinones; aryl-substituted imidazoles or derivatives thereof, for example 2,4,5-triarylimidazole dimers; 2-chlorothioxanthone and the acridine or phenacine derivatives which are effective photoinitiators. Examples of initiator systems are combinations of the stated initiators with sensitizers or activators, in particular tertiary amines. Typical examples of such initiator systems are combinations of benzophenone or benzophenone derivatives with tertiary amines, such as triethanolamine or Michler's ketone, or mixtures of 2,4,5-triarylimidazole dimers and 2-mercaptobenzoquinazole or the leuco bases of triphenylmethane dyes. The choice of the suitable photoinitiators or photoinitiator systems is familiar to the skilled worker. The photoinitiators or photoinitiator systems are present in the photopolymerizable recording layer in general in amounts of from 0.001 to 10, preferably from 0.05 to 5, % by weight, based on the photopolymerizable recording layer.

Other suitable additives and/or assistants which may be present in the photopolymerizable recording layer are, for example, thermal polymerization inhibitors, dyes and/or pigments, photochromic compounds or systems, sensitometric regulators, plasticizers, leveling agents, dulling agents, lubricants and the like. Examples of suitable thermal polymerization inhibitors are hydroquinone, hydroquinone derivatives, 2,6-di-tert-butyl-p-cresol, nitrophenols, N-nitrosamines, such as N-nitrosodiphenylamine or the salts of N-nitrosocyclohexylhydroxylamine. Examples of dyes and/or pigments, which can act both as contrast agents and as layer-reinforcing agents, include Brilliant Green Dye (C.I. 42,040), Victoria Sky Blue FGA, Victoria Sky Blue BO (C.I. 42,595), Victoria Blue B (C.I. 44,045), Rhodamine 6 G (C.I. 45,160), triphenylmethane dyes, naphthalimide dyes and 3'-phenyl-7-dimethylamino-2,2'-spirodi(2H-1-benzopyran). Photochromic systems which undergo a reversible or irreversible color change on exposure to actinic light without interfering with the photopolymerization process are, for example, leuco dyes, together with suitable activators. Examples of leuco dyes are the leuco bases of the triphenylmethane dyes, such as crystal violet leuco base and malachite green leuco base, leuco basic blue, leuco pararosaniline, leuco patent blue A or V; Rhodamine B Base is also suitable. Suitable activators for these photochromic compounds include organic halogen compounds which eliminate halogen radicals on exposure to actinic light, or hexaarylbisimidazoles. The sensitometric regulators include compounds such as 9-nitroanthracene, 10,10'-bisanthrone, phenazinium, phenoxazinium, acridinium or phenothiazinium dyes, in particular in combination with mild reducing agents, 1,3-dinitrobenzenes and the like. The conventional low molecular weight or high molecular weight esters, such as phthalates or adipates, toluenesulfonamide or tricresyl phosphate may be used as plasticizers. The additives and/or assistants are present in the photopolymerizable recording layers in the known effective amounts conventionally used for these substances.

In addition to the photosensitive substances, the copying layers can of course also contain other components. In particular, the following photosensitive materials or compounds may be used in coating the substrates:

Positive-working o-quinonediazides, in particular o-naphthoquinonediazides, such as 1,2-naphthoquinonediazide-sulfonic acid esters or -sulfonamides, which may have a low or high molecular weight, as reproduction layers containing a photosensitive compound; negative-working reproduction layers containing condensates of aromatic diazonium salts and compounds having active carbonyl groups;

negative-working reproduction layers which contain cocondensates of aromatic diazonium compounds and contain products having one or more units of a condensable aromatic diazonium salt compound and one or more units of a condensable compound such as a phenol ether or an aromatic thioether, bonded by a divalent bridge derived from a condensable carbonyl compound; e.g. a methylene group;

positive-working layers which contain a compound which eliminates an acid on irradiation, a monomeric or polymeric compound which has one or more C—O—C groups which can be eliminated by an acid (for example an orthocarboxylic ester group or a carboxamide acetal group) and, if required, a binder;

and negative-working layers which contain, as the photosensitive compound, a diazonium salt polycondensate or an organic azido compound and, as the binder, a high molecular weight polymer having alkenylsulfonyl- or cycloalkenylsulfonylurethane side groups.

The coated offset printing plates obtained from the substrates aftertreated according to the invention are converted into the desired printing plate in a known manner by imagewise exposure or irradiation and washing out of the nonimage areas with a developer, preferably an aqueous developer.

The radiation-sensitive layer may thus contain diazonium compounds, conventional polymeric condensates, quinonediazides or photopolymers. Photopolymers, and among these in particular the reaction product from the polymerization of methyl methacrylate and methacrylic acid, are preferred binders and ethylenically unsaturated monomers, and among these in particular butanediol diglycidyl diacrylates, are preferred cross-linking components.

By the use of a very wide range of functional groups, such as those bonded as radicals X to the hydrolyzed silane, the novel process makes it possible to functionalize the substrate surface in a manner relating to the relevant problem (increasing the hydrophilicity of the substrate, increasing the adhesion of the polymer). Firm binding of the silane hydrolysis product to the substrate ensures on the one hand the necessary shelf life of the printing plate, since destruction of the photosensitive layer by diffusion of the aftertreatment substance into the layer, as may be the case in other aftertreatment processes, is prevented, and on the other hand ensures long print runs, since this intermediate layer adheres firmly to the surface during printing.

Particular advantages of the addition of the F compound in combination with the silane hydrolysis products/condensates are the increase in the resistance of the printing layer to developers, in particular when strongly alkaline developers are used, without the shelf life being adversely affected as a result. The higher resistance to developers permits a very broad processing latitude during development. In practice, various developing apparatuses are used, some of them differing very greatly in their process times, i.e. in their development times. Aqueous/alkaline developers whose pH ranges from virtually neutral to strongly alkaline are also used in practice.

The novel process increases the processing latitude with regard to both the development times and the pH of the developers, so that longer development times and/or aggressive developers produce virtually no changes in the copying properties, such as dot amalgamation, optical resolution or reproduction of very fine structures, in comparison with short development times with mild developers.

The Examples which follow further illustrate the invention.

In the Examples and Comparative Examples, parts and percentages are by weight, unless stated otherwise.

The results of the tests are shown in the Table. Testing the printing plates:

The printing plates were exposed through a test negative (Ugra step wedge) using a commercial offset exposure unit (5 kW high pressure mercury lamp).

Development was then carried out using a commercial aqueous/alkaline developer (e.g. Nylolith ® EN 10 from BASF Aktiengesellschaft), two identical images being developed for 30 and 120 seconds.

The prepared printing plates were then inked by applying a typical offset printing ink by wiping over the plates.

The fully inked wedge steps were determined as a function of the substrate aftertreatment and development time, and the reproduction of fine microlines and half-tone dots was evaluated.

The printing plates produced in this manner were additionally investigated on a printing press (Heidelberg GTO) to determine their press life.

Furthermore, printing plates were subjected to an accelerated storage test in a conditioning cabinet at 60° C. and 50% atmospheric humidity and were checked at intervals to determine if they could be developed without leaving a residual layer, this being carried-out by testing the developed samples for the ink acceptance behavior of the nonimage areas (scumming) by application of offset printing ink.

Preparation of the solutions:

The hydrolysis of 3-triethoxysilylpropylsuccinic anhydride was carried out according to Example 1 of EP-A-0 256 256.

The hydrolysis of dimethyl 2-trimethoxysilylethylphosphonate was carried out according to Example 13 of EP-A-0 256 256.

2-Trihydroxysilylethylphosphonic acid can, as described in U.S. Pat. Nos. 3,780,127 and 3,816,550, be obtained by hydrolysis of a dialkyl 2-trialkoxysilylethylphosphonate (where alkyl is preferably methyl or ethyl) in concentrated HCl. After removal of excess hydrochloric acid, the product thus obtained can be diluted with water.

It is advantageous when preparing the aftertreatment solution first to dissolve the metal fluoride before adding the corresponding phosphonic acid silanol, in order to prevent precipitation of the components.

If the aftertreatment is carried out at relatively high temperatures, it is particular advantageous to establish a mean pH of 3 to 4.

COMPARATIVE EXAMPLE 1

An aluminum sheet electrochemically roughened by treatment with alternating current in aqueous HCl solution and anodically oxidized in $H_2SO_4$ and having an oxide weight of 3 g/m$^2$ is coated with a photosensitive mixture so that the layer weight is 2 g/m$^2$.

The photosensitive mixture has the following composition:

59% of a binder (70:30 copolymer of methyl methacrylate/methacrylic acid, some of whose carboxyl groups are esterified with glycidyl methacrylate; K value of a 1% strength solution=35; acid number=65 mg KOH/g of polymer), 30% of a monomer (diacrylate of 1,4-butanediol diglycidyl ether), 2% of Michler's ketone, 6% of 2-(4'-methoxynaphth-1'-yl)-4,6-bis-(trichloromethyl)-s-triazine, 1% of bromophenol blue and 2% of a plasticizer (benzenesulfonic acid n-butylamide).

The substrate coated in this manner is exposed through an Ugra step wedge using a commercial offset exposure unit (5 kW mercury vapor lamp) and is developed with an aqueous alkaline developer. The fully crosslinked wedge steps and the shelf life of the unexposed printing plate were then determined in a conditioning cabinet at 60° C. and 50% relative humidity (accelerated storage test), by storing the printing plate for an appropriate time and then exposing and developing it and applying an emulsion of a greasy ink and water to this printing plate. The time taken for the hydrophilicity to be reduced as a result of the high temperature and atmospheric humidity to such an extent that the nonimage areas accept ink in the inking test is determined. Furthermore, the adhesion and press life of the printing plates are determined by means of a print test.

COMPARATIVE EXAMPLE 2

A printing plate as described in Comparative Example 1 is produced, except that the roughened and anodized substrate is subjected to an aftertreatment with an aqueous 1% strength solution of the hydrolysis product/condensate of dimethyl 2-trimethoxysilylethylphosphonate for 20 seconds at 50° C. before being coated with the photosensitive material.

COMPARATIVE EXAMPLE 3

The procedure described in Comparative Example 2 is followed, except that the aftertreatment is carried out using a 1% strength aqueous solution of polyvinylphosphonic acid.

COMPARATIVE EXAMPLE 4

This is carried out as in Comparative Example 2, except that aqueous, 0.2% strength $K_2ZrF_6$ solution is used instead of the solution of the hydrolysis product of dimethyl 2-trimethoxysilylethylphosphonate.

COMPARATIVE EXAMPLE 5

This is carried out as for Comparative Example 2, except that aqueous 0.2% strength $K_2TiF_6$ solution is used instead of the solution of the hydrolysis product of dimethyl 2-trimethoxysilylethylphosphonate.

COMPARATIVE EXAMPLE 6

The procedure described in Comparative Example 2 is followed, except that the aftertreatment is carried out first with a 0.2% strength $K_2SrF_6$ solution, vigorous washing with fully demineralized water is then carried out followed by aftertreatment with 0.5% strength solution of the hydrolysis product of dimethyl 2-trimethoxysilylethylphosphonate and then further washing with fully demineralized water.

COMPARATIVE EXAMPLE 7

The procedure described in Comparative Example 2 is followed, except that the aftertreatment is carried out first with a 0.5% strength solution of the hydrolysis product of dimethyl 2-trimethoxysilylethylphosphonate, followed by washing with fully demineralized water and then aftertreatment with 0.2% strength $K_2ZrF_6$ solution.

EXAMPLE 1

The procedure described in Comparative Example 2 is followed, but the aftertreatment solution is prepared as follows:

The hydrolysis product of dimethyl 2-trimethoxysilylethylphosphonate (=trihydroxysilylethylphosphonic acid) is added to a 0.2% strength $K_2ZrF_6$ solution so that the solution is 0.5% strength, based on the trihydroxysilylethylphosphonic acid.

EXAMPLE 2

The procedure described in Example 1 is followed, but the aftertreatment solution contains 0.2% of $K_2TiF_6$ and 0.5% of the hydrolysis product of dimethyl 2-trimethoxysilylethylphosphonate.

EXAMPLE 3

The procedure described in Example 1 is followed, but the aftertreatment solution contains 0.2% of NaF and 0.5% of the hydrolysis product of dimethyl 2-trimethoxysilylethylphosphonate stated in Example 1.

EXAMPLE 4

The procedure described in Example 1 is followed, but the aftertreatment solution contains 0.2% of NaF and 0.5% of the hydrolysis product/condensate of 3-trimethoxysilylpropylsuccinic anhydride.

EXAMPLE 5

The procedure described in Example 4 is followed, but the NaF is replaced with 0.2% of $K_2ZrF_6$.

| Print tests | |
|---|---|
| Printing press: | Heidelberg GTO sheet-fed offset press |
| Print run: | 150,000 copies |
| Evaluation: | The subject used was the UGRA offset test wedge. In particular, the reproduced wedge steps and the micro-lines were evaluated in the print. |
| I | Up to 150,000 copies: loss of not more than 1 wedge step; 4 μm lines are not attacked; |
| II | Up to 150,000 copies: loss of at least 2 wedge steps; finest stable microlines: 12 μm; |
| III | Fragments/abrasion from solid area; Loss of the step wedge in the print: complete abrasion; finest stable microlines: 15 μm. |

TABLE

| | Fully crosslinked wedge steps 20 second exposure | | Microlines still reproduced [μm] | | Ink acceptance (scumming) at 60° C./50% humidity after . . . days | Print result | |
|---|---|---|---|---|---|---|---|
| | A | B | A | B | | A | B |
| Comp. Example 1 | 5 | 5 | 4 | 4 | Ink acceptance even before storage | Unusable for printing | |
| Comp. Example 2 | 4 | 2 | 4 | 12 | 28 | I | II |
| Comp. Example 3 | 3 | 1 | 6 | 15 | 20 | II | III |
| Comp. Example 4 | 3 | 1 | 6 | 15 | 20 | II | III |
| Comp. Example 5 | 3 | 1 | 6 | 15 | 20 | II | III |
| Comp. Example 6 | 3 | 1 | 8 | 15 | 20 | II | III |
| Comp. Example 7 | 3 | 1 | 8 | 15 | 20 | II | III |
| Example 1 | 5 | 5 | 4 | 4 | 28 | I | I |
| Example 2 | 5 | 4 | 4 | 4 | 25 | I | I |
| Example 3 | 5 | 4 | 4 | 4 | 20 | I | I |
| Example 4 | 4 | 3 | 4 | 6 | 20 | I | II |
| Example 5 | 4 | 4 | 4 | 4 | 25 | I | I |

A = Development time of 30 seconds
B = Development time of 120 seconds

It is surprising and significant that, in the aftertreatment, the F compounds of the general formulae (II) or (III) and the silane hydrolysis products of the general formula (I) must be present in one and the same bath.

Successive aftertreatment, regardless of the order, does not result in any improvement, as demonstrated by Comparative Examples 6 and 7.

We claim:

1. A process for the production of a plate-like, sheet-like or tape-like material based on mechanically, chemically, electrochemically or chemically and electrochemically roughened and anodically oxidized aluminum or aluminum alloy, the aluminum oxide layers thereof being treated with an aqueous solution of a hydrolysis product or condensate of one or more silanes of the formula (I)

$$X-(CH_2)_y-Si(R^1)_n(OR^2)_{3-n} \quad (I)$$

where $R^1$ and $R^2$ are identical or different and are each alkyl of 1 to 9 carbon atoms or aryl of 6 to 12 carbon atoms and X is one of the radicals

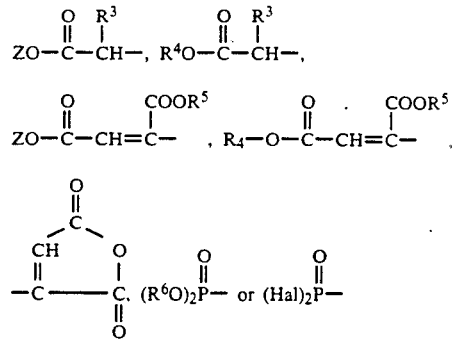

where $R^3$ is hydrogen, alkyl of 1 to 9 carbon atoms, a carboxylic acid radical of 1 to 9 carbon atoms or an anhydride ring formed from this carboxylic acid radical and the radical

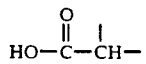

bonded to $R^3$, $R^4$ and $R^5$ are identical or different and are each alkyl of 1 to 9 carbon atoms or aryl of 6 to 12 carbon atoms, $R^6$ is hydrogen, alkyl of 1 to 9 carbon atoms or aryl of 6 to 12 carbon atoms, Z is hydrogen or alkali metal, Hal is chlorine or bromine, y is an integer of from 1 to 4 and n is 0, 1 or 2, wherein the aqueous solution of the silane hydrolysis product and/or condensate additionally contains one or more compounds of the formula (II) or (III)

$$\underset{(II)}{MF} \quad \text{or} \quad \underset{(III)}{M_2XF_6}$$

where M is an alkali metal and X is Ti, Zr or Si.

2. A process as defined in claim 1, wherein the aqueous solution has a pH of from 1.5 to 6.

3. A process as defined in claim 1, wherein the treatment with the aqueous solution is carried out in the course of from 5 to 120 seconds at from 10° to 90° C.

4. A process as defined in claim 1, wherein the aqueous solution used for the treatment contains from 0.5 to 100 g/l of a hydrolysis product and/or condensate of one or more silanes of the formula (I) and from 0.1 to 50 g/l of one or more compounds of the formula (II) or (III).

5. A process as defined in claim 1, wherein M in formula (II) or (III) is Na or K.

6. A process as defined in claim 1, wherein the aqueous solution of the silane hydrolysis product and/or condensate contains $K_2ZrF_6$.

7. A process for the production of a sensitized lithographic printing plate or offset printing plate from a substrate and a photosensitive copying layer which is applied to this substrate, wherein the substrate to be used for this purpose is prepared by the process as defined in claim 1 before being coated with the photo-sensitive copying layer.

8. A process for the production of a sensitized lithographic printing plate or offset printing plate from a substrate and a photosensitive copying layer which is applied to this substrate, wherein the substrate to be used for this purpose is prepared by the process as defined in claim 2 before being coated with the photo-sensitive copying layer.

9. A process for the production of a sensitized lithographic printing plate or offset printing plate from a substrate and a photosensitive copying layer which is applied to this substrate, wherein the substrate to be used for this purpose is prepared by the process as defined in claim 5 before being coated with the photo-sensitive copying layer.

10. A process for the production of a sensitized lithographic printing plate or offset printing plate from a substrate and a photosensitive copying layer which is applied to this substrate, wherein the substrate to be used for this purpose is prepared by the process as defined in claim 6 before being coated with the photo-sensitive copying layer.

* * * * *